US009227640B2

(12) United States Patent
Chihira et al.

(10) Patent No.: US 9,227,640 B2
(45) Date of Patent: Jan. 5, 2016

(54) VIDEO INFORMATION DELIVERY AND DISPLAY SYSTEM AND VIDEO INFORMATION DELIVERY AND DISPLAY METHOD

(75) Inventors: Masahito Chihira, Tokyo (JP); Masao Oki, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 113 days.

(21) Appl. No.: 13/508,885

(22) PCT Filed: Nov. 12, 2009

(86) PCT No.: PCT/JP2009/069298

§ 371 (c)(1),
(2), (4) Date: May 9, 2012

(87) PCT Pub. No.: WO2011/058638

PCT Pub. Date: May 19, 2011

(65) Prior Publication Data

US 2012/0224103 A1 Sep. 6, 2012

(51) Int. Cl.
*B61L 15/00* (2006.01)

(52) U.S. Cl.
CPC ..... *B61L 15/009* (2013.01); *B61L 15/0036* (2013.01); *B61L 15/0045* (2013.01)

(58) Field of Classification Search
CPC B61L 15/009; B61L 15/0036; B61L 15/0045
USPC ..... 701/19–20; 348/563, E5.099
See application file for complete search history.

(56) References Cited

U.S. PATENT DOCUMENTS

2003/0016253 A1* 1/2003 Aoki et al. ..... 345/863
2005/0008331 A1 1/2005 Nishimura et al.
2008/0295138 A1 11/2008 Emoto et al.

FOREIGN PATENT DOCUMENTS

CN 1574944 A 2/2005
JP 2001-312238 A 11/2001

(Continued)

OTHER PUBLICATIONS

International Search Report (PCT/ISA/210) issued on Dec. 8, 2009, by the Japanese Patent Office as the International Searching Authority for International Application No. PCT/JP2009/069298.

(Continued)

*Primary Examiner* — Nga X Nguyen
(74) *Attorney, Agent, or Firm* — Buchanan Ingersoll & Rooney PC

(57) ABSTRACT

The present invention provides a video information delivery and display system including display devices respectively mounted on cars of a train and including display units configured to display a guidance screen, a part-content storing unit configured to store a part content, which is a content at a part level, used for formation of the guidance screen, and a guidance-screen creating unit configured to select, according to a guidance content displayed on the guidance screen, based on train information, the part content used for the formation of the guidance screen from the part-content storing unit, arrange the selected part content on the guidance screen according to part arrangement definition data, and cause the part content to act according to part action definition data to thereby cause the display units to display the guidance content.

29 Claims, 12 Drawing Sheets

(56) References Cited

FOREIGN PATENT DOCUMENTS

| | | | | |
|---|---|---|---|---|
| JP | 2002-127905 | A | | 5/2002 |
| JP | 2003-95105 | A | | 4/2003 |
| JP | 2003-106846 | A | | 4/2003 |
| JP | 2003095105 | A | * | 4/2003 |
| JP | 2006-134120 | A | | 5/2006 |
| JP | 2006134120 | A | * | 5/2006 |
| JP | 2006-226700 | A | | 8/2006 |
| JP | 3875950 | B2 | | 1/2007 |
| JP | 2007-248162 | A | | 9/2007 |
| JP | 2008-61032 | A | | 3/2008 |
| JP | 2009-67252 | A | | 4/2009 |
| JP | 2009067252 | A | * | 4/2009 |
| WO | WO 2007/007494 | A1 | | 1/2007 |

OTHER PUBLICATIONS

Written Opinion (PCT/ISA/237) issued on Dec. 8, 2009, by the Japanese Patent Office as the International Searching Authority for International Application No. PCT/JP2009/069298.

English Translation of Office Action from JP Application No. 2010-508639 issued May 6, 2010.

English Translation of Office Action from JP Application No. 2010-230952 issued Nov. 8, 2010.

Office Action from Chinese Patent Office dated May 27, 2014, issued in corresponding Chinese Patent Application No. 200980162410.3, with English translation thereof. (31 pages).

* cited by examiner

VIDEO INFORMATION DELIVERY AND DISPLAY SYSTEM AND VIDEO INFORMATION DELIVERY AND DISPLAY METHOD

FIELD

The present invention relates to a video information delivery and display system and a video information delivery and display method for delivering and providing video information using display devices set in cars of a train.

BACKGROUND

Recently, systems are proposed and put to practical use that deliver and provide video information to passengers using display devices set in cars of a train (see, for example, Patent Literatures 1 and 2).

In these video information delivery and display systems in the past, contents forming guidance screens for destination guidance and the like (hereinafter referred to as "guidance contents") are stored in advance in storing units of the display devices as one content for each of the screens.

In this way, in the video information delivery and display system in the past, one guidance content is displayed for each of the screens stored in the storing unit. Therefore, even when information is the same except a part of train information such as a train type, a destination, or a car number, it is necessary to create one guidance content anew and store the guidance content in the storing unit. Therefore, there is a problem in that a data storage volume increases according to the number of guidance contents.

In the video information delivery and display system in the past, when the video information delivery and display system copes with, for example, addition of a station, even if there are common parts such as a train type, a destination, and a car number, it is necessary to create an entire guidance content anew. Therefore, there is a problem in that an increase in guidance contents is caused. Further, when it is desired to add, for example, date information, date information data has to be added to all guidance contents. Therefore, there is a problem in that considerable time and labor are required for correction of the guidance contents.

To solve these problems, in Patent Literature 3, in a system including display devices that display a guidance screen of a still image corresponding to train information, storing units are provided that store part contents, which are contents at a part level, respectively corresponding to pieces of information forming the guidance screen, a necessary part content is selected from the storing units according to train information, and the selected part content is arranged in a predetermined position on the guidance screen, whereby the guidance screen is formed. Consequently, it is possible to reduce a data storage volume and easily cope with addition and correction of guidance contents.

CITATION LIST

Patent Literature

Patent Literature 1: Japanese Patent Application Laid-open No. 2002-127905

Patent Literature 2: Japanese Patent Application Laid-open No. 2003-95105

Patent Literature 3: Japanese Patent No. 3875950

SUMMARY

Technical Problem

However, in the system described in Patent Literature 3, because the guidance screen is the still image, there is a problem in that an amount of information provided to passengers and attention of the passengers to the information are generally small compared with those in the case of, for example, a moving image. On the other hand, it is also conceivable to display, for example, a guidance screen of a moving image on the display devices in the train. However, in the system in the past, there is a problem in that an enormous data storage capacity is necessary for the display of the moving image.

The present invention has been devised in view of the above and it is an object of the present invention to provide a video information delivery and display system and a video information delivery and display method that can increase an amount of information provided to passengers and attention of the passengers to the information while substantially reducing a data storage capacity necessary for display of guidance contents and can easily cope with addition and correction of display contents.

Solution to Problem

In order to solve above-mentioned problems and achieve the object of the present invention, according to an aspect of the present invention, there is provided a video information delivery and display system including: train information devices respectively mounted on cars, which form a train, and configured to manage train information in association with one another; display devices respectively mounted on the cars and including display units configured to display a guidance screen; a part-content storing unit configured to store a part content, which is a content at a part level, used for formation of the guidance screen; a part-arrangement-definition-data storing unit configured to store part arrangement definition data for defining arrangement of the part content on the guidance screen; a part-action-definition-data storing unit configured to store part action definition data for defining an action of the part content on the guidance screen; and a guidance-screen creating unit configured to select, according to a guidance content displayed on the guidance screen, based on the train information obtained from the train information devices, the part content used for the formation of the guidance screen from the part-content storing unit, arrange the selected part content on the guidance screen according to the part arrangement definition data, and cause the arranged part content to act according to the part action definition data to thereby cause the display units to display the guidance content.

According to another aspect of the present invention, there is provided a video information delivery and display method for, in a train including: train information devices respectively mounted on cars, which form a train, and configured to manage train information in association with one another; display devices respectively mounted on the cars and including display units configured to display a guidance screen; and a part-content storing unit configured to store a part content, which is a content at a part level, used for formation of the guidance screen, delivering video information and causing the display devices to display the video information, the video information delivery and display method including: acquiring the train information from the train information devices; selecting, according to a guidance content displayed on the guidance screen, based on the train information, the part content used for the formation of the guidance screen from the part-content storing unit; and arranging the selected part content on the guidance screen according to the part arrangement definition data and causing the arranged part content to act according to the part action definition data to thereby cause the display units to display the guidance content.

Advantageous Effects of Invention

According to the present invention, the part content is caused to act to form the guidance screen. Therefore, it is possible to substantially reduce a data storage capacity necessary for display. According to the present invention, it is possible to increase an amount of information provided to passengers and attention of the passengers to the information compared with provision of information performed by using a still image.

According to the present invention, the guidance screen is formed by the part content and the arrangement and the actions of the part content are defined by the part arrangement definition data and the part action definition data. Therefore, it is possible to easily cope with addition and correction of display contents.

DESCRIPTION OF EMBODIMENTS

Embodiments of a video information delivery and display system and a video information delivery and display method according to the present invention are explained in detail below based on the drawings. The present invention is not limited by the embodiments.

First Embodiment

Figure 1:
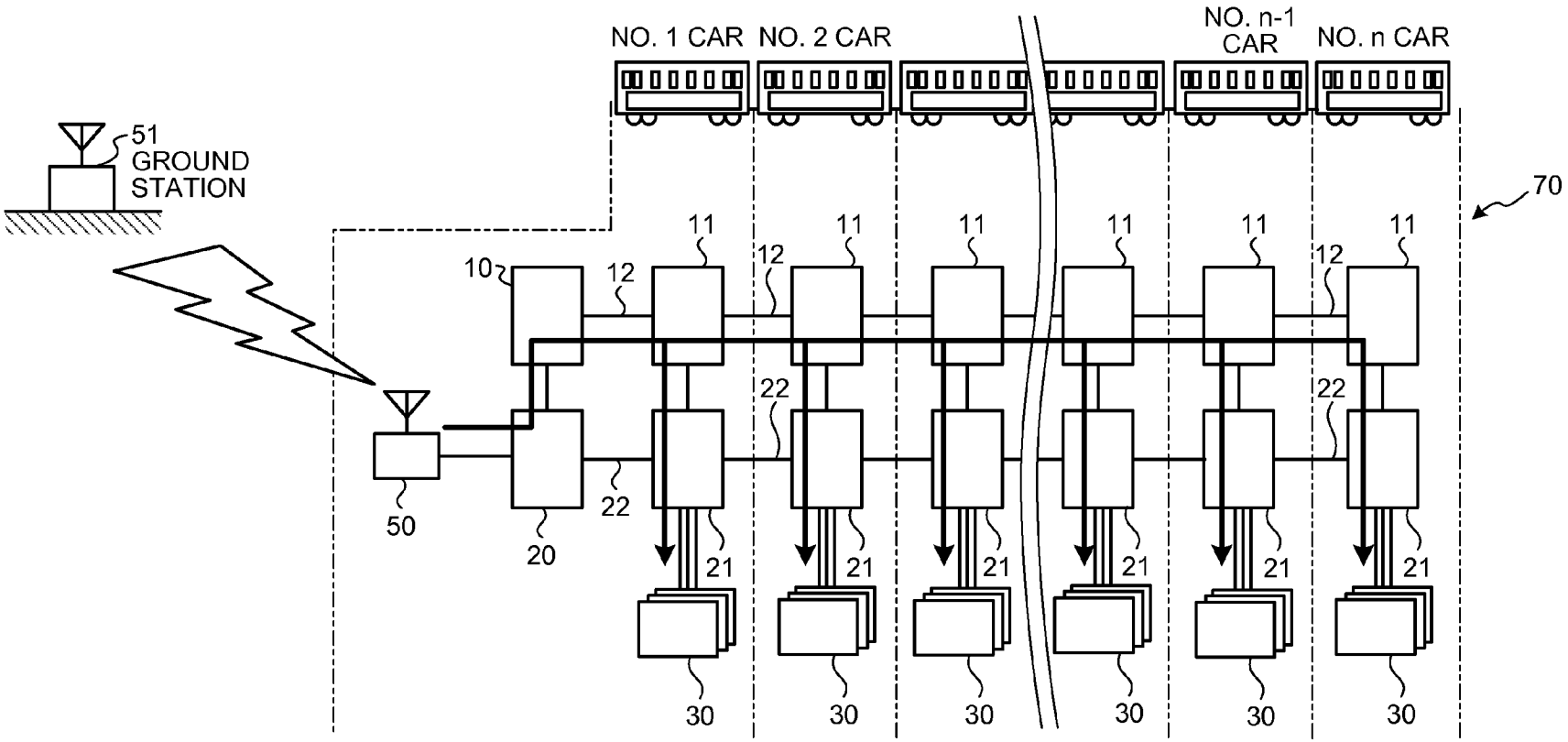
FIG. 1 is a diagram of an entire configuration of a video information delivery and display system according to a first embodiment.

FIG. 1 is a diagram of an entire configuration of a video information delivery and display system according to this embodiment. The video information delivery and display system according to this embodiment includes, for example, an onboard system 70 constructed on a train including a plurality of cars (first to nth cars; n is an integer equal to or larger than 2) and a ground station 51 functioning as a ground system. The onboard system 70 includes train information devices 10 and 11, a video information delivery device 20, diverting devices 21, display devices 30, and a radio transceiver 50. The onboard system 70 can perform transmission and reception of data between the onboard system 70 and the ground station 51 using the radio transceiver 50.

The train information device 10 is a train information central device amounted on, for example, the front car (the first car). The train information devices 11 are train information terminal devices respectively mounted on the cars. The train information devices 10 and 11 are connected to each other via a transmission line 12. The train information devices 10 and 11 perform management, collection, and the like of train information in cooperation with each other and share the train information. The train information device 10 is connected to various control devices and controls the train information devices 11. Examples of train information managed by the train information devices 10 and 11 include starting station information, train type information, number car information, destination information, train name information, traveling location information, speed information, and door opening and closing information. These kinds of train information can be notified from the video information delivery device 20 to the diverting devices 21 via a transmission line 22.

The video information delivery device 20 is mounted on, for example, the front car and performs delivery of stored video information as needed. The video information delivery device 20 is connected to the train information device 10 and the radio transceiver 50 in the same car. Further, the video information delivery device 20 is connected to the diverting devices 21, which are respectively mounted on the cars, via the transmission line 22. The diverting devices 21 are respectively connected to, for example, a plurality of display devices 30. In other words, for example, the display devices 30 are respectively mounted on the cars.

Service information and the like of a route are transmitted from the ground station 51 to the onboard system 70. The transmitted service information and the like of the route are received by the radio transceiver 50. The received service information and the like of the route are transmitted to the train information device 10 through the video information delivery device 20 and further transmitted to the train information devices 11, which are mounted on the cars, via the transmission line 12. Service information (e.g., a destination, a train type, and a starting station) of the train is input to and set in the train information device 10 during the start of a service. These kinds of service information input and set during the start of the service are transmitted to the train information devices 11 in the cars via the transmission line 12. Train information including the service information and the like of the route collected by the train information devices 11 in the cars is transmitted to and received from each other via the transmission line 12. These kinds of train information are shared by the train information devices 11 and the train information device 10. The train information devices 11 in the cars respectively transmit the train information to the display devices 30 via the diverting devices 21. These kinds of service information can be notified from the video information delivery device 20 to the diverting devices 21 via the transmission line 22.

The video information delivery device 20 acquires video information from the ground station 51 via the radio transceiver 50. This video information is, for example, part content data explained later. The video information delivery device 20 transmits the received video information to the display devices 30, which are mounted on the cars, through, for example, a route same as the route for the delivery of the train information, i.e., through the train information device 10, the train information devices 11, and the diverting devices 21. Instead of being acquired from the ground station 51, the video information can be directly input to the video information delivery device 20 using a storage medium, a notebook PC, or the like (not shown). Besides the above route, a transmission route of the video information from the video information delivery device 20 to the display devices 30 can be a route directly reaching the display devices 30 through the diverting devices 21, and not through the train information devices 10 and 11. In this case, the diverting devices 21 divert a signal, which flows through the transmission line 22, to the display devices 30 provided in the cars. In this way, these kinds of train information can be notified from the video information delivery device 20 to the diverting devices 21 via the transmission line 22.

Figure 2:
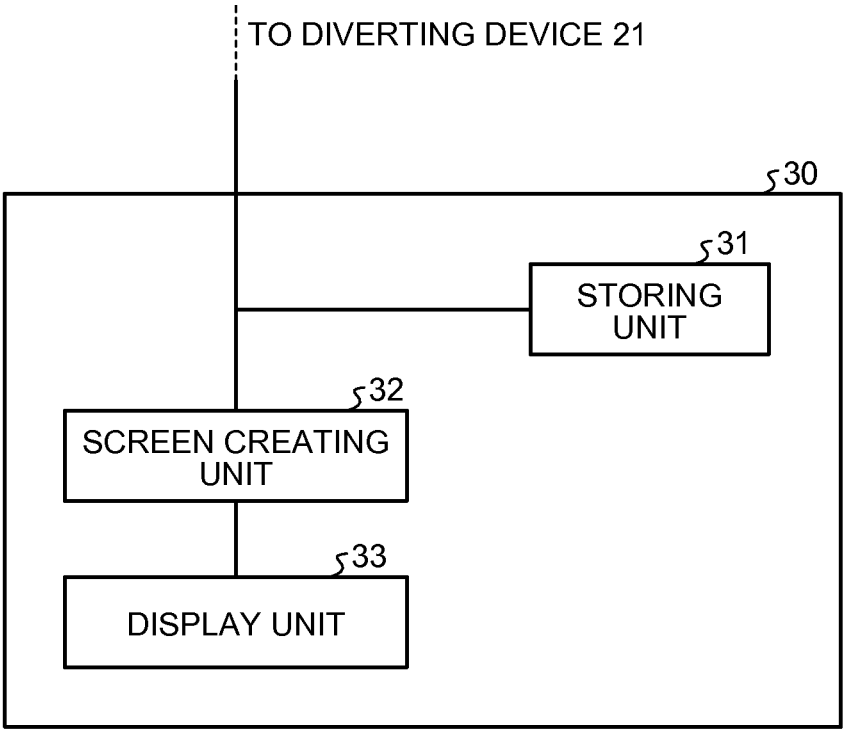
FIG. 2 is a block diagram of a configuration of a display device.

FIG. 2 is a block diagram of a configuration of the display device 30. The display device 30 includes a storing unit 31 such as a memory that stores various definition data, part content data, and the like explained later, a screen creating unit 32 that is connected to the storing unit 31 and creates a guidance screen for video information, and a display unit 33 that displays the guidance screen created by the screen creating unit 32. The screen creating unit 32 is realized by hardware such as a CPU and predetermined software that operates in cooperation with the hardware.

Figure 3:
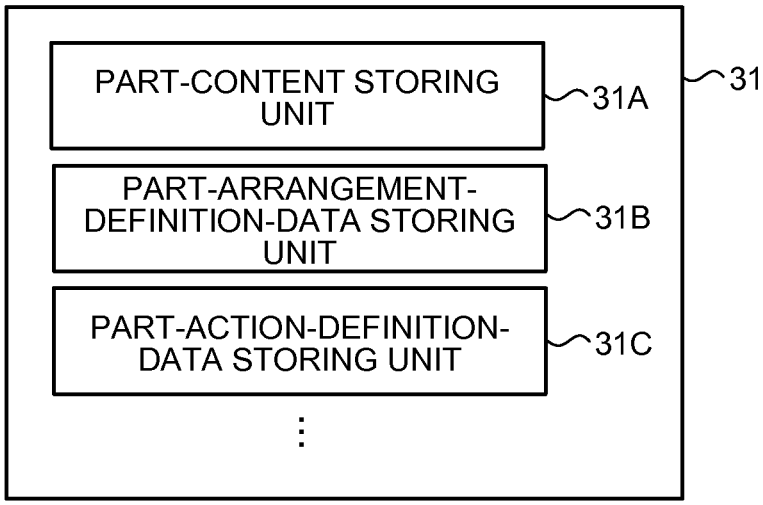
FIG. 3 is a diagram of an example of stored contents of a storing unit.

FIG. 3 is a diagram of an example of stored contents of the storing unit 31. As shown in FIG. 3, the storing unit 31 includes a part-content storing unit 31A that stores part contents, which are contents at a part level, used for forming a guidance screen, a part-arrangement-definition-data storing unit 31B that stores part arrangement definition data for defining arrangement positions of the part contents on the guidance screen, and a part-action-definition-data storing unit 31C that stores part action definition data for defining the action of the part contents on the guidance screen. As explained later, the part contents are images serving as parts. The part arrangement definition data is described in, for example, the text format in a part arrangement definition data file. The part action definition data is described in, for example, the text format in a part action definition data file. In FIG. 3, storage areas in the display device 30 are collectively shown as the storing unit 31. Therefore, the storing unit 31 does not necessarily indicate that all of the part-content storing unit 31A, the part-arrangement-definition-data storing unit 31B, and the part-action-definition-data storing unit 31C are stored in the same storage medium. The part-content storing unit 31A, the part-arrangement-definition-data storing unit 31B, and the part-action-definition-data storing unit 31C can be stored in, for example, separate storage media.

Figure 4:
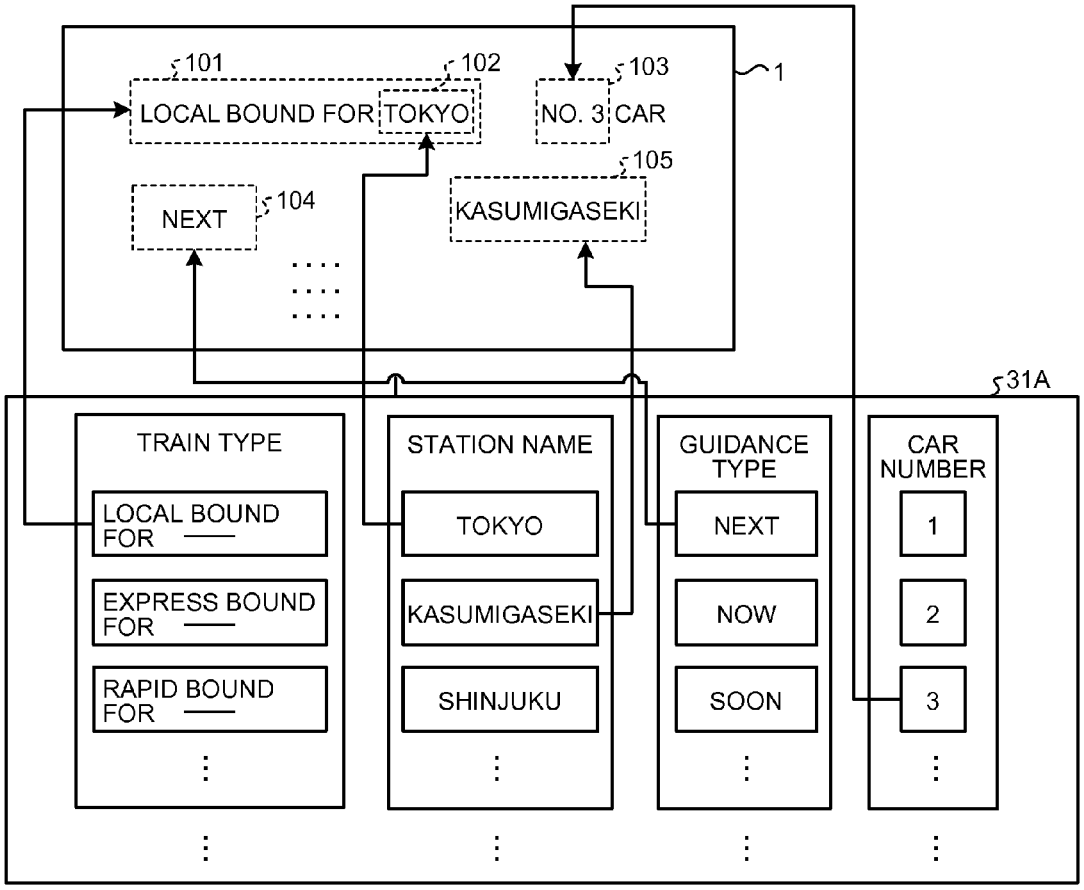
FIG. 4 is a diagram of an example of a configuration of a guidance screen.

An overview of guidance screen creation processing by the screen creating unit 32 is explained. Details of an operation are explained later. First, in this embodiment, as in the case of the still image described in Patent Literature 3, a guidance screen is formed by assembling parts. For example, as shown in FIG. 4, when kinds of information concerning a train type 101, a destination 102, a car number 103, a guidance type 104, and a station name 105 are displayed on a guidance screen 1, these kinds of information are respectively formed as parts. After acquiring train information from the train information devices 11, the screen creating unit 32 selects, from the part-content storing unit 31A, a part content corresponding to train information acquired for each of the parts. For example, when it is determined based on the train information that a train type is "local train", the screen creating unit 32 selects "local train bound for" as a part content that should be used for display of the train type 101. The same holds true concerning the other parts. The screen creating unit 32 selects part contents corresponding to train information. A part content group stored in the part-content storing unit 31A is image data of a still image, which is delivered from the video information delivery device 20.

Subsequently, the screen creating unit 32 arranges, referring to the part arrangement definition data stored in the part-arrangement-definition-data storing unit 31B, the part contents (the train type 101, the destination 102, the car number 103, the guidance type 104, the station name 105, etc.) respectively in predetermined positions on the guidance screen 1. In other words, the screen creating unit 32 forms a guidance screen 1 by pasting the selected part contents to the guidance screen 1 and assembling the part contents. The guidance screen 1 formed in this way is an initial screen (a first frame) that forms guidance contents.

Each of the part contents has a small data volume compared with one guidance screen. The part contents can be diverted to various guidance contents. Therefore, it is possible to reduce a data storage capacity of the entire system by using such part contents.

In this embodiment, not only sections (e.g., the train type 101 shown in FIG. 4), display contents of which change depending on train information, but also sections (e.g., a base section), display contents of which do not depend on the train information, can be parts. When at least one part is defined, the remaining sections of the guidance screen 1 can also be regarded as parts. For example, when a configuration in which the train type 101, the destination 102, the car number 103, the guidance type 104, the station name 105, and the like shown in FIG. 4 is pasted to a base section having a uniform background color is considered, the base section can also be regarded as a part. When the sections, display contents of which do not depend on the train information, are also regarded as parts, in some case, such parts can be shared among different guidance contents. This contributes to a reduction in the content storage capacity of the entire system. For example, it is effective to regard a map portion used in a plane route map as a part because it is highly likely that the map portion regarded as the part can be shared.

The screen creating unit 32 refers to the part action definition data stored in the part-action-definition-data storing unit 31C. The part action definition data defines the actions of part contents on the guidance screen 1. Examples of the actions of the part contents include a moving action, a rotating action, an expanding or reducing action, and an appearing or disappearing action. The appearing or disappearing action represents a change in which the transmittance of the part contents temporally changes and the part contents gradually appear from a transparent state or gradually shift to the transparent state. A change in a color (changes in a hue, a tint, brightness, etc.) can be included in this action. Besides, various actions can be defined.

Figure 5:
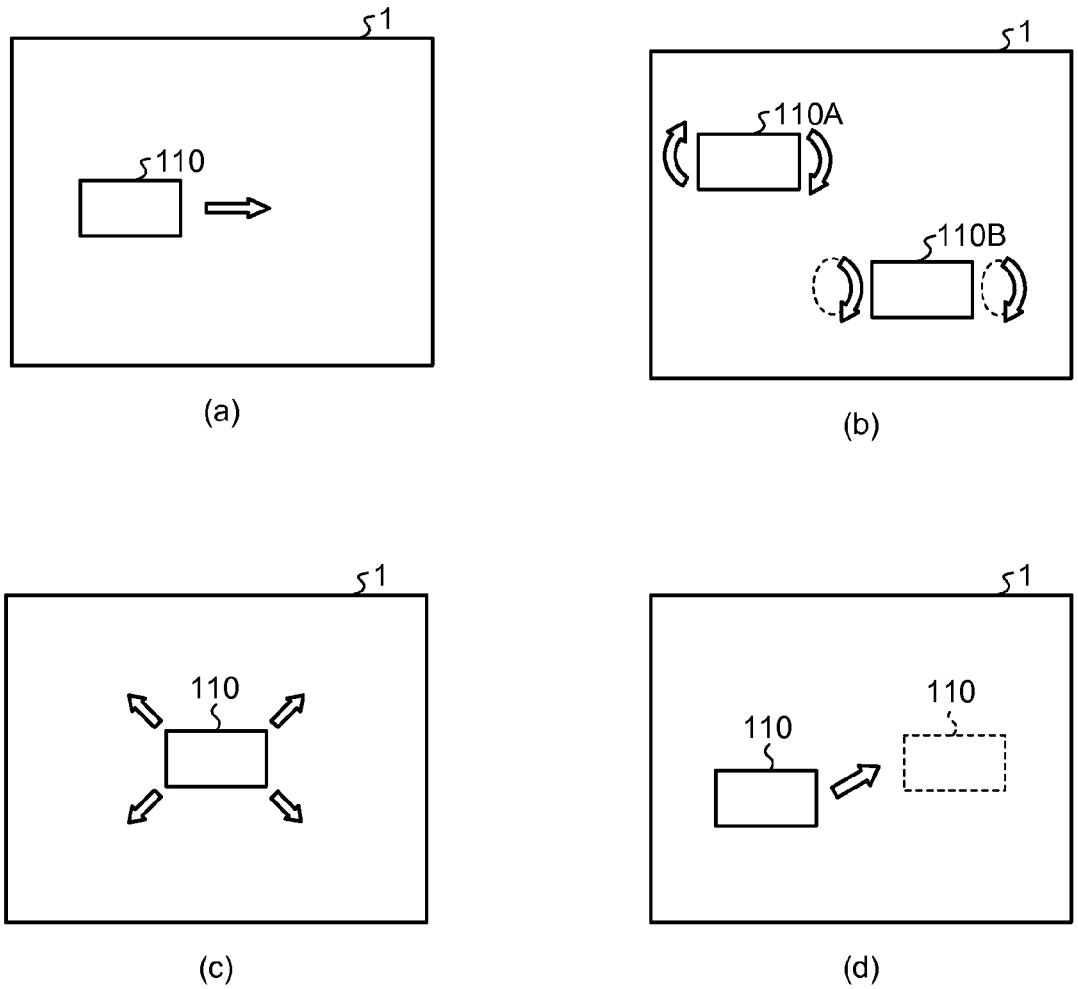
FIG. 5 is a diagram of action examples of a part content.

FIG. 5 is a diagram of action examples of a part content 110. In FIG. 5(*a*), the action of the part content 110 translating in one direction is shown. An arrow indicates the moving direction. In FIG. 5(*b*), the action of a part content 110A rotating clockwise in the guidance screen 1 is shown. The action of a display content of a part content 110B rotating in an arrow direction about a horizontal axis parallel to the guidance screen 1 is shown. In this case, although the arrangement position of the part content 110B does not change, the display content thereof rotates. In FIG. 5(*c*), an action of the part content 110 being expanded is shown. In FIG. 5(*d*), an action of the part content 110 translating in an arrow direction is shown. In the action, the transmittance of the part content 110 increases as time elapses. The part content 110 is gradually made transparent.

The screen creating unit 32 sequentially creates the guidance screen 1 in which the part contents are caused to act according to the part action definition data and performs display of guidance contents by causing the display unit 33 to display the guidance screen 1. As explained later in detail, the screen creating unit 32 creates a screen in which the part contents are caused to slightly act from the initial screen and creates a screen in which the part contents are further caused to slightly act from the created screen. In this way, the screen creating unit 32 sequentially creates a plurality of screens in which the part contents are caused to act according to the part action definition data and performs display of guidance contents by displaying these screens in time series.

Figure 6:
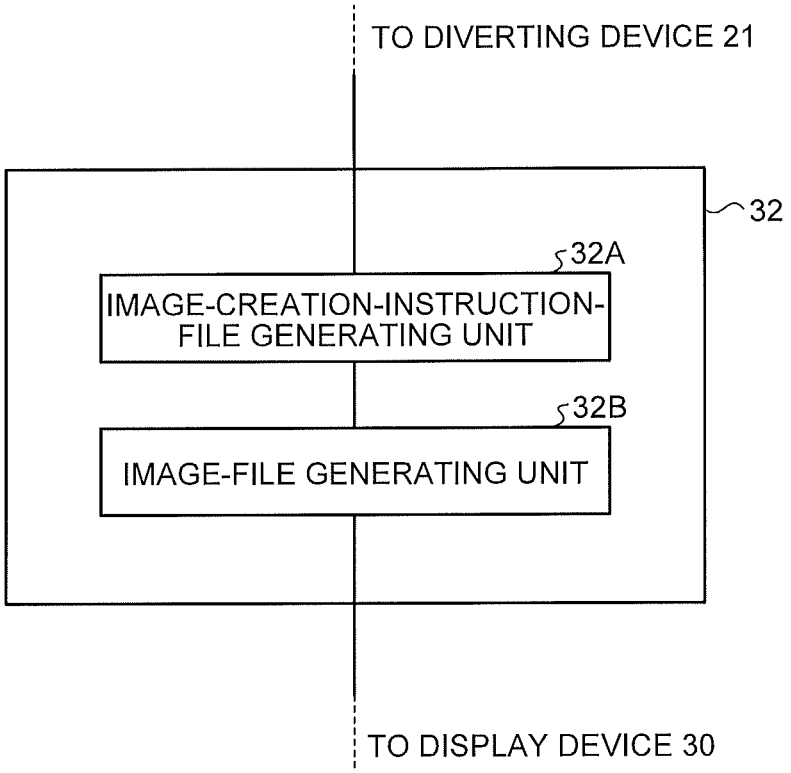
FIG. 6 is a diagram of a functional configuration of a screen creating unit.
Figure 7:
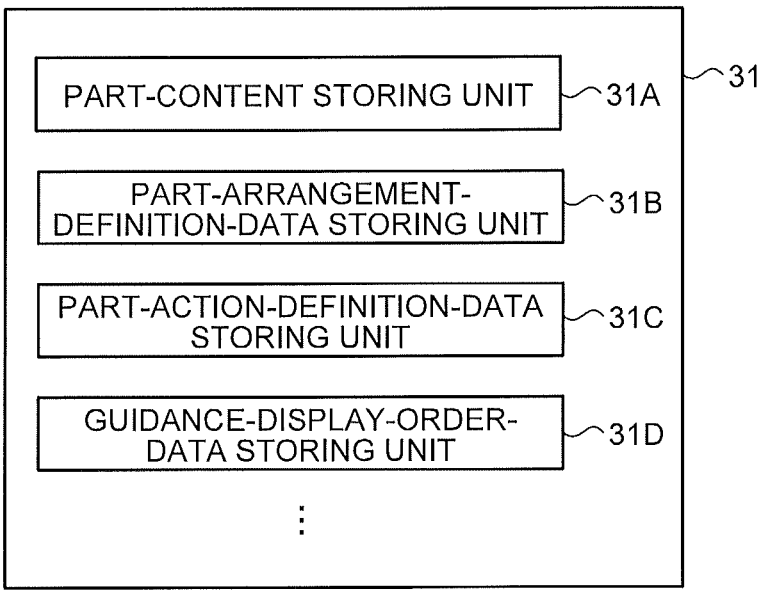
FIG. 7 is a diagram of a more detailed example of stored contents of the storing unit.
Figure 8:
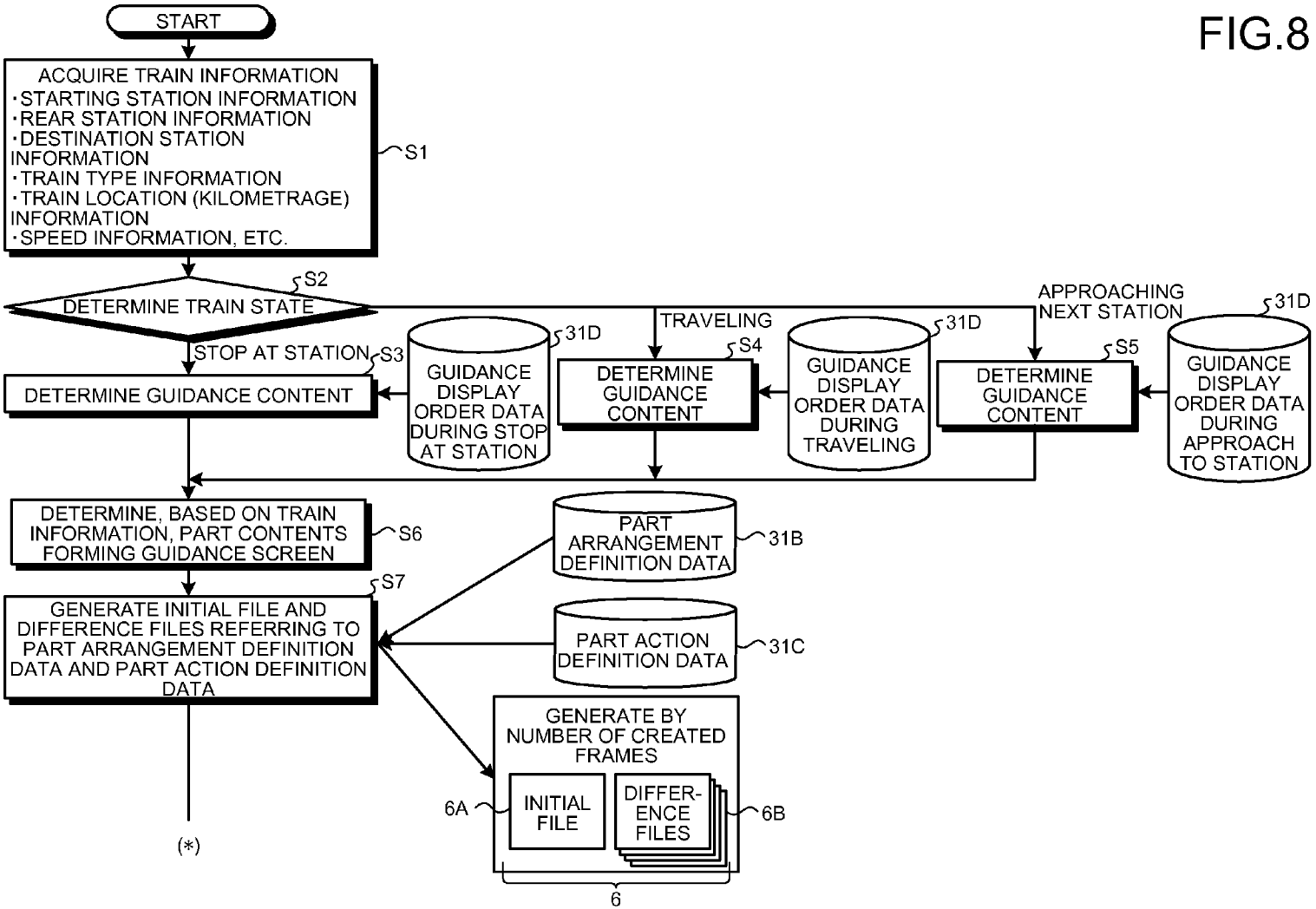
FIG. 8 is a flowchart for explaining an operation in the first embodiment.
Figure 9:
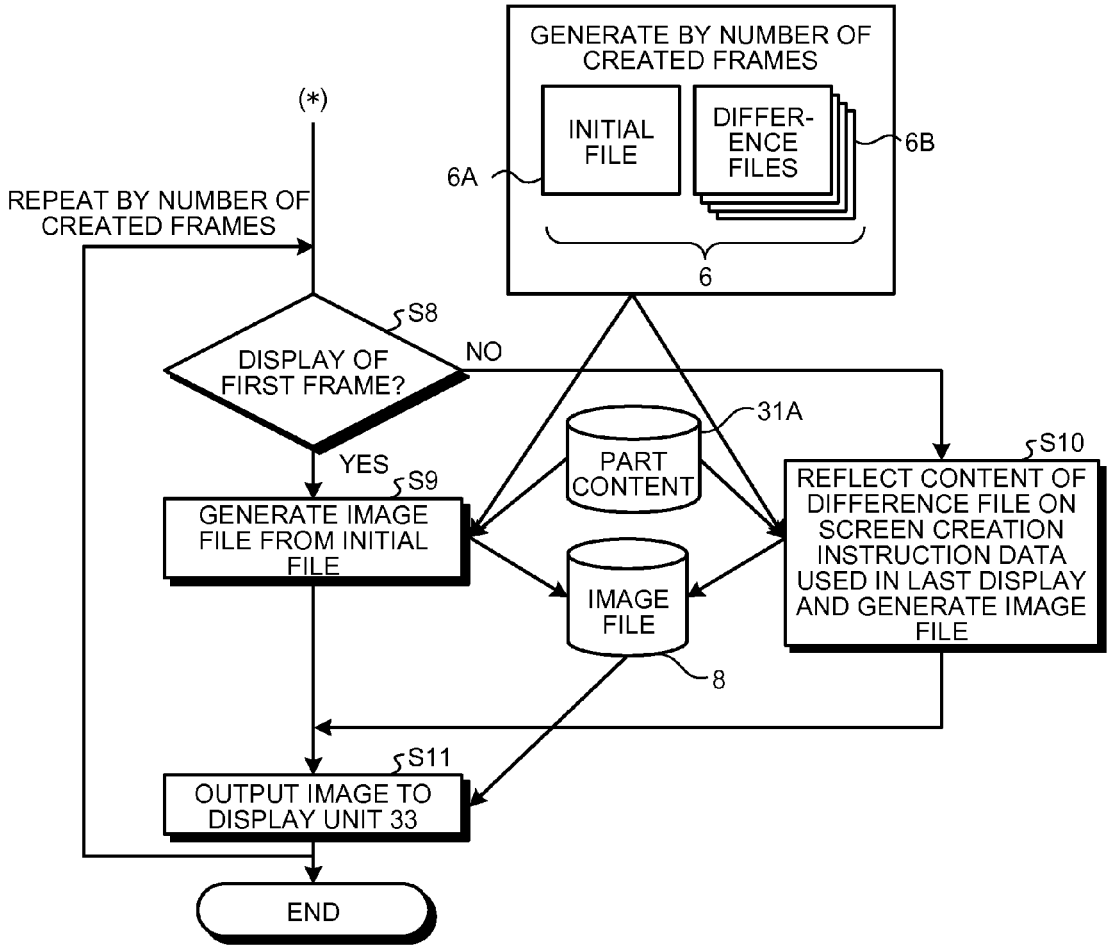
FIG. 9 is a flowchart following FIG. 8.
Figure 10:
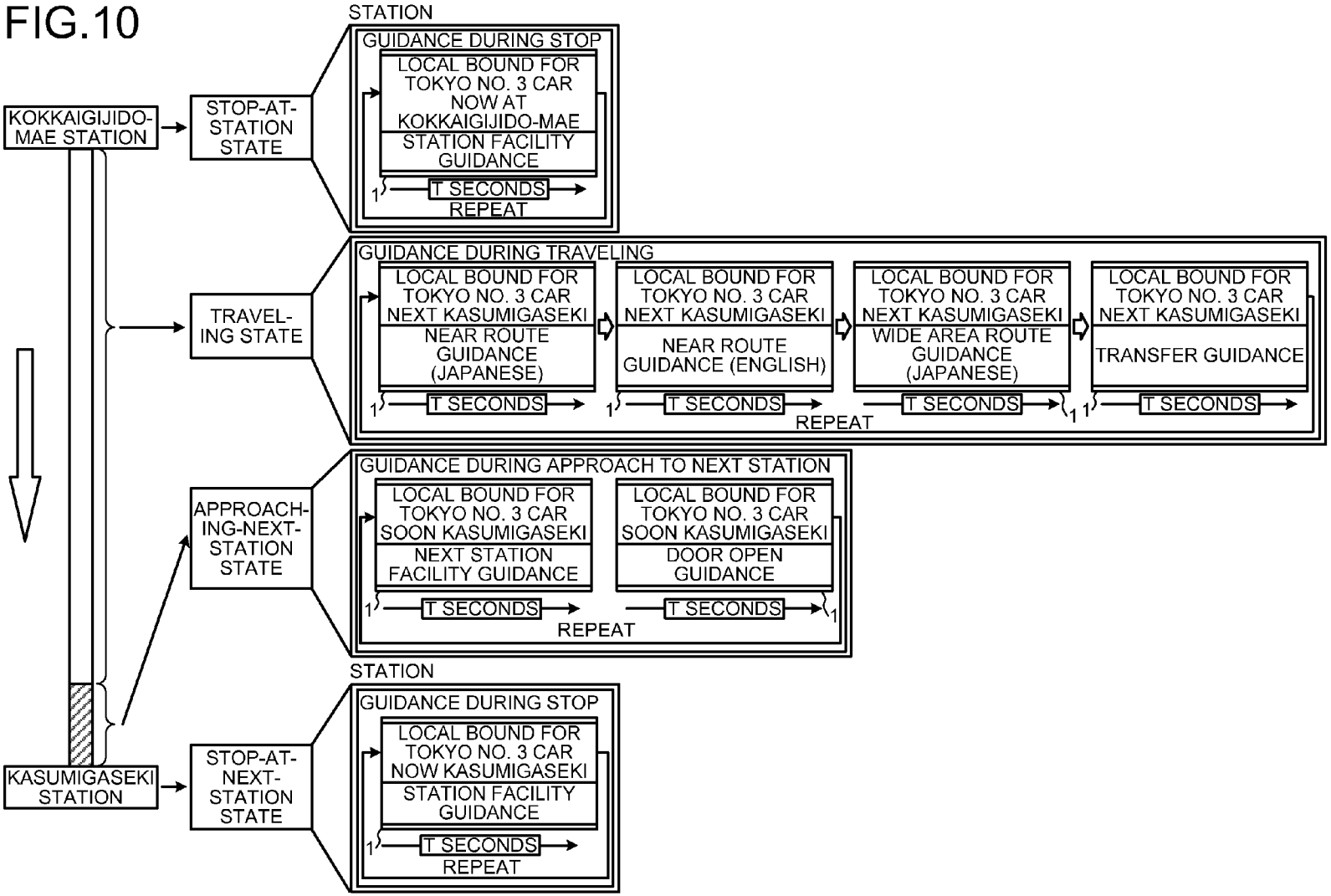
FIG. 10 is a diagram of a guidance display example between stations.

The operation in this embodiment is explained in detail with reference to FIGS. 6 to 10. FIG. 6 is a diagram of a functional configuration of the screen creating unit 32. FIG. 7 is a diagram of a more detailed example of stored contents of the storing unit 31. FIG. 8 is a flowchart for explaining the operation in this embodiment. FIG. 9 is a flowchart following FIG. 8. FIG. 10 is a diagram of a guidance display example between stations.

As shown in FIG. 6, the screen creating unit 32 includes a screen-creation-instruction-file generating unit 32A that generates a screen creation instruction file 6 (see FIG. 8), which is a file in which creation instruction contents for a plurality of continuous frames (formation images) in time series that form guidance contents, are described and an image-file generating unit 32B that generates the frames based on this screen creation instruction file. As shown in FIG. 7, the storing unit 31 includes, in addition to the configuration shown in FIG. 3, a guidance-display-order-data storing unit 31D that stores guidance display order data during a stop at a station, guidance display order data during traveling, and guidance display order data during approach to a station.

As shown in FIG. 8, first, the screen-creation-instruction-file generating unit 32A acquires train information (S1). The train information can be directly acquired from the train information devices 11 or can be acquired from the storing unit 31 after being once stored in the storing unit 31.

Subsequently, the screen-creation-instruction-file generating unit 32A determines a train state based on the acquired train information (S2). Specifically, the train information is classified into, for example, train information during a stop at a station, train information during traveling, and train information during approach to the next station. The screen-creation-instruction-file generating unit 32A determines, from the acquired train information, in which of the three states the train is. These three states are an example. Other classifications can be adopted.

When it is determined as a result of the determination of the train state at S2 that the train is, for example, stopping at a station, the screen-creation-instruction-file generating unit 32A determines, referring to the guidance display order data during a stop at a station stored in the guidance-display-order-data storing unit 31D, guidance contents (referred to as roles) that should be sequentially displayed at the station at which the train stops (S3). In an example shown in FIG. 10, when the train is stopping at, for example, the "Kokkaigijido-mae" station, a guidance content "station facility guidance" is displayed. This is because it is described in the guidance display order data during a stop at a station that the "station facility guidance" should be displayed at the station. The "station facility guidance" is repeatedly displayed in a predetermined time (this time is set to T seconds.) as a unit.

When it is determined as a result of the determination of the train state at S2 that the train is traveling, the screen-creation-instruction-file generating unit 32A determines, referring to the guidance display order data during traveling stored in the guidance-display-order-data storing unit 31D, guidance contents (roles) that should be sequentially displayed during traveling (S4). In the example shown in FIG. 10, when the train is traveling between the "Kokkaigijido-mae" station and the "Kasumigaseki" station, the screen-creation-instruction-file generating unit 32A displays "near route guidance (Japanese)", "near route guidance (English)", "wide area route guidance (Japanese)", and "transfer guidance" in this order according to the description of the guidance display order data during a stop. Each of the guidance contents of "near route guidance (Japanese)", "near route guidance (English)", "wide area route guidance (Japanese)", and "transfer guidance" is displayed in T seconds as a unit in the same manner as described above. These roles are repeatedly displayed.

When it is determined as a result of the determination of the train state at S2 that the train is approaching the next station, the screen-creation-instruction-file generating unit 32A determines, referring to the guidance display order data during approach to the next station stored in the guidance-display-order-data storing unit 31D, guidance contents (roles) that should be sequentially displayed during approach to the next station (S5). In the example shown in FIG. 10, when the train is approaching, for example, the "Kasumigaseki" station, the screen-creation-instruction-file generating unit 32A displays "next station facility guidance" and "door opening guidance" in this order according to the guidance display order data during approach to a station. Each of the guidance contents of "next station facility guidance" and "door opening guidance" is displayed in T seconds as a unit in the same manner as the above description. These roles are repeatedly displayed. The screen-creation-instruction-file generating unit 32A determines whether the train is approaching the next station according to, for example, whether a distance from the train to the next station is equal to or smaller than a predetermined distance.

The screen-creation-instruction-file generating unit 32A determines, according to the guidance contents (roles) that should be displayed, based on the train information, part contents used for formation of the guidance screen 1 (S6). For example, as shown in FIG. 4, when the train type 101 is one of parts, the screen-creation-instruction-file generating unit 32A determines "local train bound for" as a part content when it is determined based on the train information that the train is "local train".

The screen-creation-instruction-file generating unit 32A acquires initial arrangement information on the guidance screen 1 of the part contents by referring to the part arrangement definition data stored in the part-arrangement-definition-data storing unit 31B and acquirers initial information concerning actions of the part contents by referring to the part action definition data stored in the part-action-definition-data storing unit 31C. The screen-creation-instruction-file generating unit 32A generates, from these kinds of acquired information, an initial file 6A in which creation instruction contents for creating a first frame forming a guidance content are described (S7). The initial file 6A is one of the screen creation instruction files 6 described above. A screen creation instruction file can be created by, for example, embedding the acquired information in a template file (not shown) prepared in advance for each of guidance contents. The template file serving as a basis of such a screen creation instruction file is stored in the storing unit 31 in advance.

As the part arrangement definition data, arrangement positions of the part contents used for the formation are defined, for example, for each type of a guidance content or guidance, by, for example, coordinate values of an XY coordinate set on the guidance screen 1. The part action definition data defines an action of each of parts (i.e., each of part contents) forming the guidance screen 1. As a specific example of the part action definition data, for example, concerning a part P1, it is described that the part P1 is rotated 90° counterclockwise at constant angular velocity on the guidance screen 1 from 0 second at the start to T seconds at the end. For example, concerning a part P2, it is described that the part P2 stands still from 0 second at the start to T1 seconds, moves at equal velocity in a fixed direction from T1 seconds to T2 seconds, and stands still again from T2 seconds to T seconds at the end. For example, concerning a part P3, it is described that the part P3 does not act. For example, concerning a part P4, it is described that transmittance is 100% from 0 second at the start to T3 seconds, the transmittance decreases to 50% from T3 seconds to T4 seconds, and the part P4 is displayed at fixed transmittance again from T4 seconds to T seconds at the end. For example, concerning a part P5, it is described that the part P5 is displayed at a size of 100% from 0 second at the start to T5 seconds, the size is increased to 150% from T5 seconds to T6 seconds, and a fixed size is maintained again from T5 seconds to T seconds at the end.

The initial file 6A includes an instruction for initial arrangement positions of part contents obtained from the part arrangement definition data and includes, for example, when the transmittance of the part contents temporally changes, an instruction for initial transmittance (i.e., initial information of the action) obtained from the part action definition data. Besides, the initial file 6A includes information necessary for creation of the first frame such as information concerning association of the part contents used for the formation and image files actually stored in the part-content storing unit 31A. The initial file 6A is desirably, for example, a text file for the purpose of a reduction in a data storage capacity. In this case, instruction contents necessary for creation of the guidance screen 1 are described in a text format.

The screen-creation-instruction-file generating unit 32A generates, based on the part action definition data, a plurality of difference files 6B in which creation instruction contents of remaining all frames following the first frame are individually described (S7). These difference files 6B are files for instructing creation of difference display contents for the continuous frames and are the screen creation instruction files 6.

To specifically explain the difference files 6B, it is assumed that the guidance contents are formed in, for example, T seconds and, for example, M frames are generated and displayed in T seconds (M is an integer equal to or larger than 2). M is set to a number equal to or larger than a number for allowing the guidance contents to be smoothly displayed. Action examples of parts described in the part action definition data are explained with the action of the part P1 as an example. It is assumed that the part P1 rotates 90° counterclockwise on the guidance screen 1 in T seconds. Then, the part P1 rotates (90/M)° counterclockwise among the continuous frames. The screen-creation-instruction-file generating unit 32A calculates, as in this example, based on the description of the part action definition data, actions among the frames as difference information and describes the difference information in the difference files 6B. Specifically, after generating the initial file 6A, the screen-creation-instruction-file generating unit 32A generates a first difference file 6B in which difference information indicating that, for example, the part P1 rotates (90/M)° counterclockwise is described as a creation instruction content for a second frame following the first frame. In this configuration, the second frame can be created by the initial file 6A and the first difference file 6B. Similarly, the screen-creation-instruction-file generating unit 32A generates a second difference file 6B in which a creation instruction content for a third frame following the second frame is described as a difference display content between the frames. The third frame can be created by the initial file 6A and the first and second difference files 6B. The same holds true in other cases. The initial file 6A and the difference files 6B are stored in the storing unit 31.

As explained above, in this embodiment, the screen-creation-instruction-file generating unit 32A generates the initial file 6A and the difference files 6B as the screen creation instruction files 6 for creating a plurality of frames forming a guidance content. However, instead of generating the difference files 6B, it is also possible to create files similar to the initial file 6A for all the frames. For example, instead of generating the first difference frame 6B to correspond to the second frame, it is also possible to generate, from the beginning, a file obtained by combining the contents of the initial file 6A and the first difference file 6B. As in this embodiment, because the difference files 6B are generated, it is unnecessary to describe redundant contents among the frames. Therefore, there is an effect that a data storage capacity can be reduced.

Display processing for guidance contents by the image-file generating unit 32B is explained. As shown in FIG. 9, first, the image-file generating unit 32B determines whether a display is a display of the first frame (S8). When the display is started, the display is a display of the first frame (Yes at S8). Therefore, in this case, the image-file generating unit 32B selects, based on the initial file 6A, necessary part contents from the part-content storing unit 31A and generates a first image file 8 (S9). The image file 8 is, for example, an RGB file. The image-file generating unit 32B outputs an image based on the generated first image file 8 to the display unit 33 as the first frame (S11).

On the other hand, when the display is a display of a frame after the first frame (a frame other than the first frame) as a result of the determination at S8 (No at S8), the image-file generating unit 32B generates, based on data contents obtained by reflecting contents of the difference files 6B for creating a display target frame on screen creation instruction data used in the last display, the image file 8 corresponding to the data contents (S9). The screen creation instruction data used in the previous display is data of the initial file 6A or the initial file 6A and the difference files 6B used for creation of a file displayed immediately before the display. For example, when a second frame is displayed, the screen creation instruction data used in the last display is data of the initial file 6A. For example, when a third frame is displayed, the screen creation instruction data used in the last display is data of the initial file 6A and the first difference file 6B. In other words, contents of the difference files 6B of the display target frame are added to data used for creation of an immediately preceding frame and already expanded on a memory to simplify the processing and realize a reduction in a data storage capacity.

Subsequently, the image-file generating unit 32B outputs an image based on the generated image file 8 to the display unit 33 as a display target frame (S11). Thereafter, the same operation is repeated until display of all frames ends. In this way, the image-file generating unit 32B generates the image files 8 respectively based on the screen creation instruction files 6 for the number of generated frames and expands and displays these image files 8 in time series on the display unit 33 to display guidance contents (roles).

The image-file generating unit 32B generates an image adjusted to a size of an actual guidance screen from the image files 8 and stores this image in a frame buffer (not shown) provided in the display unit 33. The display unit 33 reads out the image in the frame buffer and displays the image on a screen.

It is desirable to set the capacity of the frame buffer to a capacity enough for storing a plurality of guidance contents. In this case, the image-file generating unit 32B can store, for example, an image group concerning a guidance content scheduled to be displayed next in the frame buffer in addition to an image group concerning a guidance content currently displayed. Consequently, after the end of display of the guidance content currently displayed, image groups concerning a guidance content scheduled to be displayed next can be immediately read out and displayed sequentially. Therefore, a display switching becomes smooth.

The image-file generating unit 32B can generate an image from the image files 8 and, after storing this image in the frame buffer, erase the image files 8, whose image generation ends. Consequently, it is unnecessary to store the image files 8 having a large data size after the image generation. It is possible to substantially reduce a data storage capacity.

In guidance during traveling shown in FIG. 10, four kinds of roles are displayed in order in T seconds as a unit. For example, "near route guidance (English)" is displayed following "near route guidance (Japanese)". Therefore, while the image-file generating unit 32B carries out the processing shown in FIG. 9 and causes the display unit 33 to display "near route guidance (Japanese)", the screen-creation-instruction-file generating unit 32A can carry out the processing shown in FIG. 8 for "near route guidance (English)" to be displayed next and cause the image-file generating unit 32B to generate the initial file 6A and the difference files 6B. In other words, the image file creation processing by the image-file generating unit 32B concerning a guidance content currently displayed and the generation processing (FIG. 8) for the screen creation instruction files 6 by the screen-creation-instruction-file generating unit 32A concerning a guidance content scheduled to be displayed next can be performed in parallel. Consequently, it is unnecessary to start the display processing after all the screen creation instruction files 6 for the four kinds of roles are generated. A configuration suitable for smoothly shifting the roles is obtained.

In FIG. 10, for example, when the train is in a traveling state, the image generation processing by the image-file generating unit 32B concerning a guidance content during traveling scheduled to be displayed next to the guidance content currently displayed and the image generation processing by the image-file generating unit 32B concerning guidance contents during approach to the next station scheduled to be displayed in a state of approach to the next station can also be performed in parallel. For example, the image generation processing concerning "near route guidance (English)" and the image generation processing concerning "next station facility guidance" of guidance contents during approach to the next station can also be performed in parallel during a display of "near route guidance (Japanese)" of the guidance contents during traveling. Consequently, when a train state change occurs, a display switching can be smoothly realized by giving an interrupt instruction to the image-file generating unit 32B. Image groups of guidance contents created in the parallel processing are stored in the frame buffer as explained above.

When a data format of data stored in the part-content storing unit 31A is, for example, so-called vector data, the image-file generating unit 32B can easily generate, based on the initial file 6A and the difference files 6B, an image file obtained by causing part contents to act. However, this embodiment is not limited to a display method employing this data format.

Figure 11:
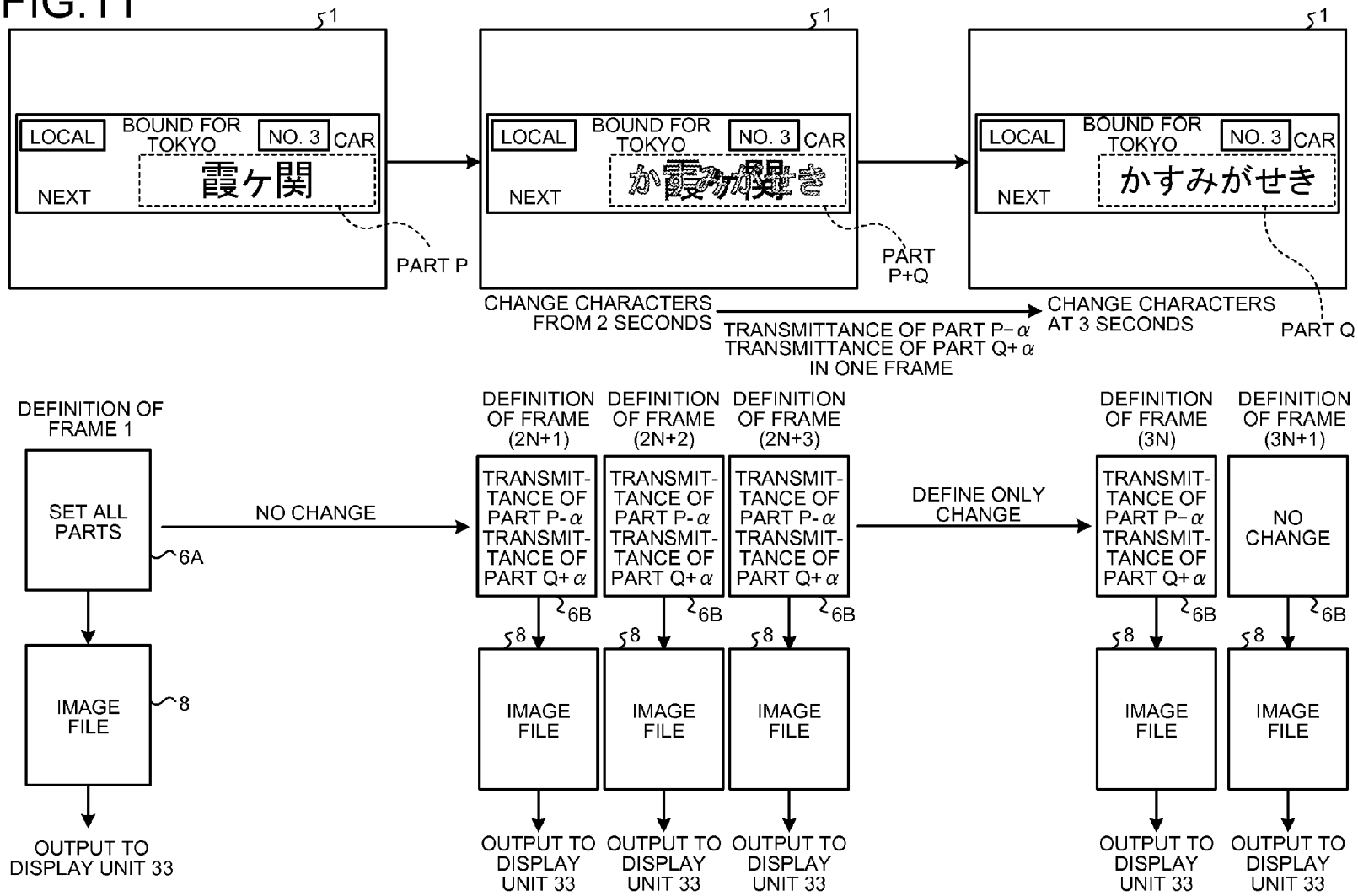
FIG. 11 is a schematic diagram of a display method for a guidance content.
Figure 12:
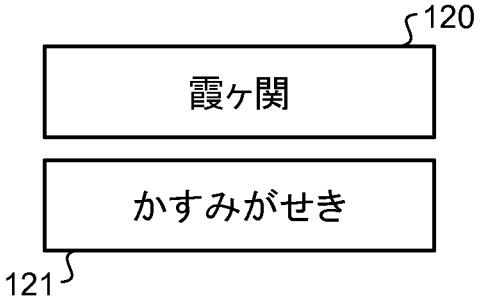
FIG. 12 is a diagram of an example of part contents.

FIG. 11 is a schematic diagram of the display method for guidance contents. FIG. 12 is a diagram of an example of part contents displayed in FIG. 11. In FIG. 11, an example in which a display content of the part P, which is one of the parts forming the guidance screen 1, changes, for example, from 2 seconds to 3 seconds and a station name to be displayed is changed is shown.

Specifically, characters are changed from "Kasumigaseki in Chinese characters" to "Kasumigaseki in hiragana characters".

In FIG. 12, a part content 120 arranged in the part P and a part content 121 arranged in a part Q are shown.

The part contents 120 and 121 are respectively still images on which "Kasumigaseki in hiragana characters" and "Kasumigaseki in Chinese characters" are inscribed.

As shown in FIG. 11, for "frame 1", which is the first frame, arrangement information and the like concerning all parts are described in the initial file 6A. After the image file 8 is created based on the initial file 6A, an image corresponding to the image file 8 is output on the display unit 33. There is no change in a display of the guidance screen 1 from 0 second at the start to, for example, 2 seconds. Therefore, an action is not set in the difference files 6B and the same image is output by the image file 8 same as "frame 1". In the following explanation, it is assumed that, for example, N frames are displayed in one second.

Subsequently, for "frame (2N+1)", which is a (2N+1)th frame displayed after the elapse of 2 seconds, it is described in the difference files 6B used for creation of the frame that "the transmittance of the part P changes by $-\alpha$ and the transmittance of the part Q changes by $+\alpha$". After the image file 8 is created based on the difference files 6B and the initial file 6A, an image corresponding to the image file 8 is output to the display unit 33. Thereafter, an operation performed up to "frame (3N+1)" is as explained with reference to FIGS. 8 and 9.

As it is seen from comparison of the display content of the part P shown in FIG. 11 and the part content 120 shown in FIG. 12, an action is specified such that the part content 120 is displayed from the start to 2 seconds, the transmittance of the part content 120 falls from 2 seconds to 3 seconds, and the transmittance of the part content 121 rises, whereby the change of the characters ends at 3 seconds.

As a result, "Kasumigaseki in hiragana characters" is displayed.

The action is obtained by combining the actions of the part content 110 shown in FIG. 5(*d*) (excluding the parallel translation).

As explained above, according to this embodiment, the guidance screen 1 for the guidance contents is formed using the part contents. Therefore, it is possible to substantially reduce a data storage capacity necessary for display, i.e., the capacity of the storing unit 31.

According to this embodiment, it is possible to increase an amount of information provided to passengers and attentions of the passengers to the information, a visual appealing effect to the passengers increases, and it is possible to more effectively provide information compared with provision of information performed by using a still image.

According to this embodiment, the guidance screen 1 is formed by the part contents. The arrangements and the actions of the part contents are defined by the part arrangement definition data and the part action definition data. Therefore, it is possible to easily cope with additions and corrections of display contents.

In this embodiment, the difference files 6B are generated as the screen creation instruction files for creating the second and subsequent frames. Therefore, it is unnecessary to describe redundant display contents among the frames. It is possible to reduce a data storage capacity.

The image-file generating unit 32B can generate an image from the image files 8 and, after storing this image in the frame buffer, erase the image files 8, whose image generation ends. Consequently, it is unnecessary to store the image files 8 having a large data size after the image generation. It is possible to substantially reduce a data storage capacity.

The image file generation processing by the image-file generating unit 32B concerning a guidance content currently displayed and the generation processing for a screen creation instruction file by the screen-creation-instruction-file generating unit 32A concerning a guidance content scheduled to be displayed next can be performed in parallel. Consequently, a creation of a screen creation instruction file for the next guidance content is not started after the end of display of the guidance content currently displayed. A period in which no guidance content is displayed does not occur between the guidance contents.

In FIG. 10, the image generation processing concerning a guidance content scheduled to be displayed next to the guidance content currently displayed and the image generation processing concerning a guidance content scheduled to be displayed in a train state scheduled next to the train state can also be performed in parallel. Consequently, when a train state change occurs, display switching can be smoothly realized by giving an interrupt instruction to the image-file generating unit 32B.

For example, in the guidance during traveling shown in FIG. 10, a display content in a display area in the lower half of the guidance screen changes according to a guidance content. However, a display content in the display area in the upper half does not change among guidance contents. For example, when the guidance content "near route guidance (Japanese)" and the guidance content "near route guidance (English)" are compared, a display content changes only in the display area in the lower half. Therefore, if the guidance screen is divided into a plurality of display areas and the initial file 6A and the difference files 6B are created in a unit of a display area, when guidance contents are repeatedly displayed in T seconds as a unit as shown in FIG. 10, it is possible to share these files concerning the display areas in which a display content does not change. Consequently, it is possible to reduce a load of generation processing for the screen creation instruction file 6.

A change in a color can also be added to the actions of part contents. For example, as the train approaches the next station, it is also possible to perform display for increasing attentions of passengers by, for example, gradually changing character displays from black to blue and from blue to red.

In this embodiment, functions necessary for guidance content creation such as the screen creating unit 32, the part-content storing unit 31A, the part-arrangement-definition-data storing unit 31B, and the part-action-definition-data storing unit 31C are provided in the display device 30. When a plurality of the display devices 30 are provided in a car, such a configuration is suitable for displaying different guidance contents for each of the display devices 30.

On the other hand, the functions necessary for guidance content creation can also be provided in, for example, the diverting devices 21 shown in FIG. 1. In FIG. 1, a plurality of the display devices 30 are connected to one diverting device 21. With such a configuration, even when a plurality of the display devices 30 are provided in a car, screen creating units 32 equivalent to the number of the diverting devices 21 are provided. Therefore, the configuration is more inexpensive than the configuration in this embodiment. However, such a configuration is suitable for displaying the same guidance contents in all the display devices 30 in the car.

As still another configuration, the functions necessary for guidance content creation can also be provided in, for example, the video information delivery device 20. Such a configuration is still more inexpensive because the number of the set screen creating units 32 is further reduced. The configuration is suitable for displaying the same guidance contents in all the display devices 30 in the train. In this case, the video information delivery device 20 delivers created guidance contents to the display devices 30 rather than delivering part contents.

According to this embodiment, a still image can also be displayed. Specifically, all part contents only have to be defined as "no action" in the part action definition data. For example, in FIG. 11, a still image is substantially displayed from the start of display to 2 seconds.

In the guidance contents in this embodiment, it is also possible to embed a photographed video in a part of the guidance screen 1, display this photographed video at a same timing as the timing for frame display, and cause a photographed video display section to act, for example, move in the guidance screen 1. However, because the photographed video requires a large data size, it is desirable to use the photographed video while limiting the data size. When such a photographed video is used, as in Patent Literature 3, a route for transmitting data from the video information delivery device 20 to the display devices 30 can be divided for transmission of part contents and transmission of the photographed video. In other words, in Patent Literature 3, the photographed video is transmitted to the display devices 30 directly through the diverting devices 21 without being transmitted through the train information devices 11.

Second Embodiment

In the first embodiment, the system and the method for selecting, based on train information obtained from the train information devices 11, part contents necessary for formation of guidance contents from the part content group stored in the part-content storing unit 31A in advance, assembling these part contents, and giving actions to the part contents to perform display of the guidance contents are explained.

In the second embodiment, a system and a method for incorporating, in guidance contents, information not directly obtained from the train information devices 11, for example, temporary information provided from the outside of a train and displaying the temporary information are explained. The temporary information is, for example, service information, accident information, or a news flash. Such temporary information is provided from, for example, the ground station 51 by radio communication.

Figure 13:
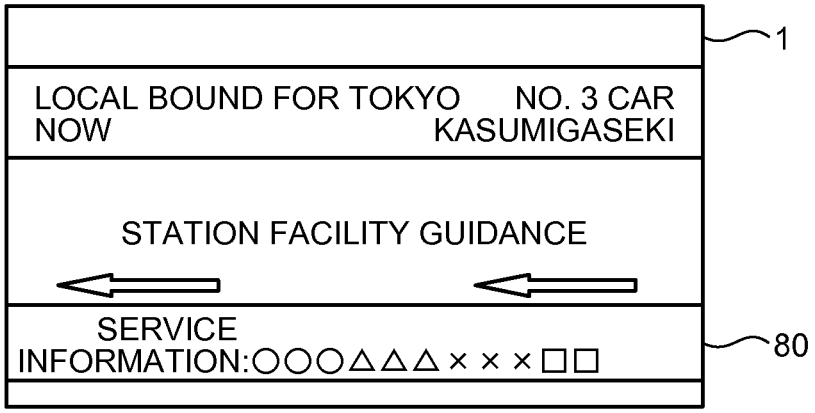
FIG. 13 is a diagram of a display example of a guidance content according to a second embodiment.
Figure 14:
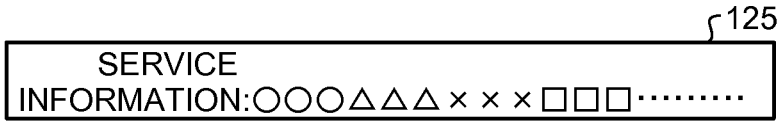
FIG. 14 is a diagram of an example of part contents provided as a character drawing.

FIG. 13 is a diagram of a display example of a guidance content according to this embodiment. FIG. 14 is a diagram of an example of part contents in which temporary information (e.g., temporary service information) described in a text is represented as a character drawing. In FIG. 13, on a display section of "station facility guidance" of the guidance screen 1, a part 80 in which temporary information is displayed is arranged to be overwritten. As the part 80, a part content 125 shown in FIG. 14 is selected. The action of the part content 125 is defined such that characters move in a direction of an arrow shown in FIG. 13. In this way, in the part 80, the temporary service information is displayed by so-called telop. A content of the display is displayed while moving in the arrow direction.

To perform the display shown in FIG. 13, the screen-creation-instruction-file generating unit 32A creates, after the temporary information is acquired, the part content 125 in which a content of the temporary information is processed into a character drawing. In the part arrangement definition data, initial arrangement positions of part contents created to correspond to temporary information are defined in advance. In the part action definition data, actions of part contents created to correspond to temporary information are defined in advance. FIG. 13 is a diagram of an example of the initial arrangement position and the action. The screen-creation-instruction-file generating unit 32A generates, based on the part arrangement definition data and the part action definition data, concerning the part contents forming the guidance screen 1, the initial file 6A and the difference files 6B explained in the first embodiment besides the created part content 125. The image-file generating unit 32B sequentially generates, based on the initial file 6A and the difference files 6B, image files for frames and outputs images corresponding to the image files to the display unit 33.

In the display example shown in FIG. 13, the display of the temporary service information by the part 80 is performed to overwrite a guidance content currently displayed. Therefore, there is a problem in that a part of the guidance content cannot be seen. Therefore, in displaying the temporary information, it is also possible to reduce and display, in the guidance screen 1, the entire guidance content currently displayed, arrange the part 80 in a formed margin section, and define an action to perform a same telop display as the above description in the part 80. In this case, although the entire guidance content is slightly hard to see because the entire guidance content is reduced, the telop display does not overwrite a part of the guidance content. Therefore, it does not occur that information in a part of the guidance content is not displayed.

In the above explanation, the temporary information is obtained from, for example, the ground station 51. However, the temporary information can be input to the video information delivery device 20 via a predetermined input means by, for example, a crew member on a car. For example, the crew member can input temporary information concerning a failure, an accident, or a sick person in a train on which the crew member works to the video information delivery device 20 via an input screen or the like of an onboard monitor device. The temporary information input onboard is displayed by telop on the guidance content in the same manner as described above. Therefore, it is possible to provide information having higher real-time properties than the information from the ground station 51.

According to this embodiment, for example, temporary information provided from the outside of a train or input onboard is processed into a part content as a character drawing and the part content is incorporated in a moving image of a guidance content and displayed. Therefore, it is possible to provide passengers with the temporary information on a real-time basis. The other components, actions, and effects of this embodiment are the same as those in the first embodiment.

Third Embodiment

In this embodiment, as a specific example of the actions of part contents, actions of parts displayed as if the parts are rotating on a guidance screen according to a combination of reducing and expanding actions are explained. A configuration and the like of this embodiment are the same as those in the first and second embodiment. Actions are defined in part action definition data.

Figure 15:
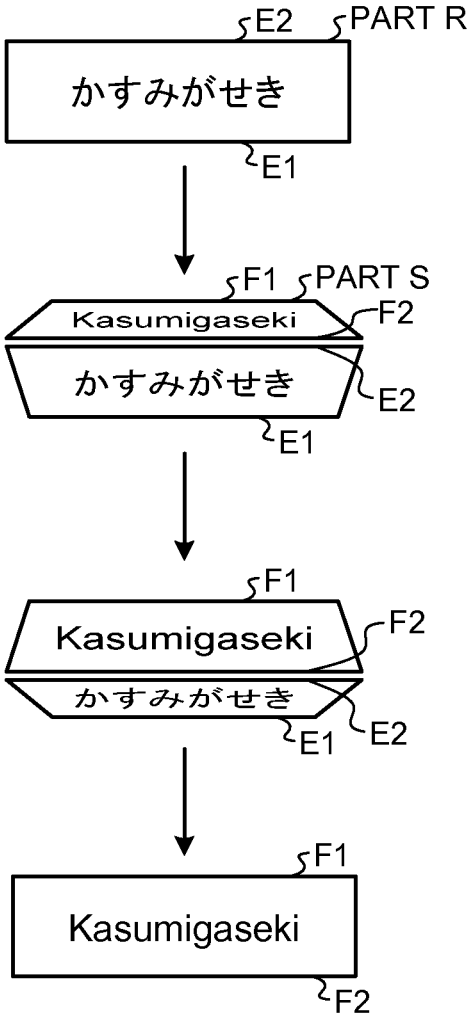
FIG. 15 is a diagram of an action example of part contents in a third embodiment.
Figure 16:
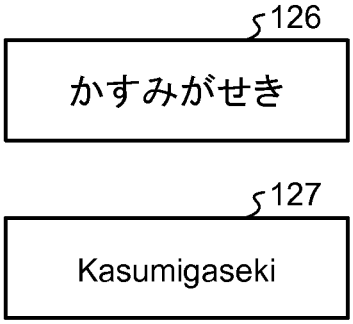
FIG. 16 is a diagram of an example of part contents.
Figure 17:
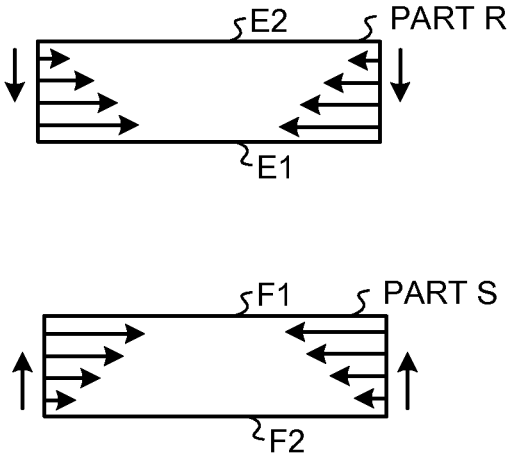
FIG. 17 is a schematic diagram depicting reducing directions of a part R and a part S.

FIG. 15 is a diagram of an action example of part contents in this embodiment. FIG. 16 is a diagram of an example of the part contents. FIG. 17 is a schematic diagram of reducing directions of a part R and a part S.

As shown in FIG. 15, for example, in a rectangular area on a guidance screen, the part R reduces and the part S expands, whereby the parts R and S are displayed as if the parts R and S rotate.

Specifically, display switching is performed from "Kasumigaseki in hiragana characters" of the part R to "Kasumigaseki" of the part S.

The top section in the figure indicates an action start state and the bottom section indicates an action end state. The part R is displayed based on a part content 126 shown in FIG. 16 and the part S is displayed based on a part content 127 shown in FIG. 16.

First, the action of the part R is explained. In the figure, the vertical direction is referred to as a first direction and a direction orthogonal to the first direction is referred to as a second direction. The part R is reduced at, for example, a fixed reducing speed (referred to as a first reducing speed) in the first direction in a state in which an end E1, which is one end of the part R in the first direction, is fixed not to move in the first direction. Specifically, the action of the part R is specified such that the part R reduces in the first direction from the start of the action to the end of the action and has no width in the first direction in an action end state. Therefore, an end E2, which is the other end of the part R, opposed to the end E1 moves downward at the first reducing speed, whereby an area where the part S is displayed is formed on the upper side of the end E2 and this formed area gradually increases.

The part R reduces in the first direction and also reduces in the second direction. However, reducing speed of the part R in the second direction increases at a fixed rate from 0 to predetermined reducing speed (referred to as second reducing speed) from the end E2 toward the end E1. Therefore, the length of the end E2 is fixed but the length of the end E1 decreases as time elapses. Therefore, there is an effect that the part R is displayed with temporally-changing perspective given thereto. The part R looks as if the part R is rotating downward with the second direction as a rotation axis. In the upper section of FIG. 17, a reducing direction of the part R is schematically indicated by an arrow. To indicate that the reducing speed increases toward the bottom, the sizes of arrows in the horizontal direction are shown to increase toward the bottom.

The action of the part S is explained. For convenience of explanation, the action of the part S is specified as an opposite action of an action from the end of the action to the start of the action in time reversal. Specifically, when the part S shifts from the action end state in the bottom section of FIG. 15 to the action start state in the top section, the part S is reduced in the first direction at the first reducing speed in a state in which an end F1, which is one end in the first direction of the part S, is fixed not to move in the first direction. In other words, the action of the part S is specified such that the part S reduces in the first direction and has no width in the first direction in the action start state. The part S reduces in the first direction and also reduces in the second direction. However, reducing speed of the part S in the second direction increases at a fixed rate from 0 to the second reducing speed from an end F2 toward the end F1. Therefore, like the part R, the part S is displayed with temporally-changing perspective given thereto. In the lower section of FIG. 17, a reducing direction of the part S in time reversal is schematically indicated by an arrow. However, the action of the part S in a forward direction of time is actually equivalent to an expanding action. As shown in FIG. 15, the end F2 of the part S and the end E2 of the part R are arranged to be opposed to each other.

According to this embodiment, by combining a combination of reducing actions of the part R and a combination of expanding actions of the part S as explained above, it is possible to display the parts R and S as if the parts R and S are rotating.

This embodiment can be applied not only to the case of the two parts but also to a case of three or more parts. Naturally, the part R or the part S can be independently displayed. In this case, character display disappears or appears as if the character display rotates.

In the explanation of this embodiment, the rotating direction is downward in the figures. However, the same explanation applies when the rotating direction is an arbitrary direction of the guidance screen.

INDUSTRIAL APPLICABILITY

As explained above, the present invention is useful as a video information delivery and display system and a video information delivery and display method that can increase an amount of information provided to passengers and substantially reduce a data storage capacity.

REFERENCE SIGNS LIST

1 GUIDANCE SCREEN
6 SCREEN CREATION INSTRUCTION FILE
6A INITIAL FILE
6B DIFFERENCE FILES
8 IMAGE FILES
10, 11 TRAIN INFORMATION DEVICES
12 TRANSMISSION LINE
20 VIDEO INFORMATION DELIVERY DEVICE
21 DIVERTING DEVICES
22 TRANSMISSION LINE
30 DISPLAY DEVICES
31 STORING UNIT
31A PART-CONTENT STORING UNIT
31B PART-ARRANGEMENT-DEFINITION-DATA STORING UNIT
31C PART-ACTION-DEFINITION-DATA STORING UNIT
31D GUIDANCE-DISPLAY-ORDER-DATA STORING UNIT
32 SCREEN CREATING UNIT
32A SCREEN-CREATION-INSTRUCTION-FILE GENERATING UNIT
32B IMAGE-FILE GENERATING UNIT
33 DISPLAY UNIT
50 RADIO TRANSCEIVER
51 GROUND STATION
70 ONBOARD SYSTEM
80 PART
101 TRAIN TYPE
102 DESTINATION
103 CAR NUMBER
104 GUIDANCE TYPE
105 STATION NAME
110 PART CONTENT
110A PART CONTENT
110B PART CONTENT
120 PART CONTENT
125 PART CONTENT

The invention claimed is:

1. A video information delivery and display system comprising:

train information devices respectively mounted on cars, which form a train, and configured to manage train information in association with one another;

display devices respectively mounted on the cars and including display units configured to display a guidance screen;

a part-content storing unit configured to store a plurality of part contents, each of the part contents is a content at a part level, used for formation of the guidance screen;

a part-arrangement-definition-data storing unit configured to store part arrangement definition data for defining arrangement of the part content on the guidance screen relative to other contents on the guidance screen;

a part-action-definition-data storing unit configured to store part action definition data for individually defining an action of the part content itself on the guidance screen; and a screen creating unit configured to select; according to a guidance content displayed on the guidance screen, based on a train state which has been determine based on the train information obtained from the train information devices, one of the part contents used for the formation of the guidance screen from the part-content storing unit, arrange the selected part content on the guidance screen according to the part arrangement definition data, sequentially create, for each of a plurality of continuous frames in time series obtained by changing little by little the arranged part content on the guidance screen according to the part action definition data, image files serving as sources of creating the frames, display the frames based on the image files on the display units in time series, and erase the image files from a memory after the display.

2. The video information delivery and display system according to claim 1, wherein a number of frames created by the screen creating unit in one second is set to a number for making the display in time series of the guidance content on the display units smooth.

3. A video information delivery and display system comprising:

train information devices respectively mounted on cars, which form a train, and configured to manage train information in association with one another;

display devices respectively mounted on the cars and including display units configured to display a guidance screen;

a part-content storing unit configured to store a plurality of part contents, each of the part contents is a content at a part level, used for formation of the guidance screen a part-arrangement-definition-data storing unit configured to store part arrangement definition data for defining arrangement of the part content on the guidance screen relative to other contents on the guidance screen;

a part-action-definition-data storing unit configured to store part action definition data for individually defining an action of the part content itself on the guidance screen; and a screen creating unit configured to; select, according to a guidance content displayed on the guidance screen, based on a train state which has been determined based on the train information obtained from the train information devices, one of the part contents used for the formation of the guidance screen from the part-content storing unit, arrange the selected part content on the guidance screen according to the part arrangement definition data, sequentially create, for each of a plurality of frames continuous in time series obtained by changing little by little the arranged part content on the guidance screen according to the part action definition data, image files serving as sources of creating the frames, and display the frames based on the image files on the display units in time series, and erase the image files from a memory after the display.

4. The video information delivery and display system according to claim 1, wherein the action of the part content includes at least one of a moving action, a rotating action, an expanding or reducing action, an appearing or disappearing action, and a change in a color.

5. The video information delivery and display system according to claim 1, wherein the screen creating unit creates, based on initial arrangement information on the guidance screen of the part content obtained from the part arrangement definition data and initial information of the action of the part content obtained from the part action definition data, a first frame using the part content and creates frames after the first frame formed by causing the part content to act little by little on the guidance screen according to the part action definition data.

6. The video information delivery and display system according to claim 5, wherein the guidance-screen creating unit includes:

a screen-creation-instruction-file generating unit configured to generate a plurality of screen creation instruction files in which creation instruction contents of the frames included in the guidance content are respectively described; and an image-file generating unit configured to generate the frames based on the screen creation instruction files.

7. The video information delivery and display system according to claim 6, wherein the plurality of screen creation instruction files include an initial file in which a creation instruction content necessary for creation of the first frame, which is an initial screen of the guidance content, is described and difference files respectively generated for the remaining frames excluding the first frame, creation instruction contents of the difference files being difference display contents between the frames and frames immediately prior to the frames.

8. The video information delivery and display system according to claim 7, wherein the screen-creation-instruction-file generating unit determines, according to the guidance content, based on the train information, the part content used for the formation of the guidance screen from the part-content storing unit, generates the initial file for creating the first frame by acquiring initial arrangement information on the guidance screen of the part content referring to the part arrangement definition data and acquiring initial information of the action of the part content referring to the part action definition data, and creates the difference file referring to the part action definition data.

9. The video information delivery and display system according to claim 7, wherein the image-file creating unit determines whether display of the guidance content is display of the first frame, when the display of the guidance content is the display of the first frame as a result of the determination, after selecting, based on the initial file, the part content used for the formation of the guidance screen from the part-content storing unit and generating an image file, outputs an image based on the generated image file to the display units as the first frame, and, when the display of the guidance content is display of a frame after the first frame as a result of the determination, after generating an image file corresponding to the display target frame using data obtained by reflecting a content of the difference file for creating the display target frame on data used for creation of a frame immediately prior to the display target frame, outputs an image based on the generated image file to the display units as the display target frame.

10. The video information delivery and display system according to claim 6, wherein, after storing an image generated from the image file in frame buffers of the display devices, the image-file generating unit erases the image file.

11. The video information delivery and display system according to claim 10, wherein the frame buffers have a capacity for storing a plurality of the guidance contents, and in the frame buffers, the image group concerning at least the guidance content scheduled to be displayed next is stored in addition to the image group concerning the guidance content currently displayed.

12. The video information delivery and display system according to claim 6, wherein image file generation processing by the image-file generating unit concerning the guidance content currently displayed and image creation instruction file generation processing by the screen-creation-instruction-file generating unit concerning the guidance content scheduled to be displayed next are performed in parallel.

13. The video information delivery and display system according to claim 6, wherein the screen-creation-instruction-file generating unit generates the screen creation instruction file for each of a plurality of display areas obtained by dividing the guidance screen.

14. The video information delivery and display system according to claim 6, wherein the screen-creation-instruction-file generating unit determines a train state based on the train information and determines, according to the train state, the guidance content displayed by the display units.

15. The video information delivery and display system according to claim 14, wherein the train state is classified into states including a state during a stop at a station, a state during traveling, and a state during approach to a next station.

16. The video information delivery and display system according to claim 15, wherein, when the guidance content is displayed in any one of the train states of the train, image file generation processing by the image-file generating unit concerning the guidance content scheduled to be displayed next to the guidance content currently displayed and image file generation processing by the image-file generating unit concerning the guidance content scheduled to be displayed in the train state scheduled next to the train state are performed in parallel.

17. The video information delivery and display system according to claim 1, wherein, when temporary information is provided from an outside of the train, the guidance-screen creating unit creates a part content obtained by processing a content of the provided temporary information into a character drawing and causes the display unit to display the created part content together with the guidance content according to the part arrangement definition data and the part action definition data.

18. The video information delivery and display system according to claim 1, wherein, when temporary information is input via a predetermined input unit on the train, the guidance-screen creating unit creates a part content obtained by processing a content of the input temporary information into a character drawing and causes the display units to display the created part content together with the guidance content according to the part arrangement definition data and the part action definition data.

19. The video information delivery and display system according to claim 1, wherein the action defined by the part action definition data includes any one of a translating action, a rotating action, an expanding or reducing action, an appearing or disappearing action, and a change in a color or an arbitrary combination of these actions.

20. The video information delivery and display system according to claim 19, wherein, in an action of continuous display switching from an action start state in which only a first part content selected from the part-content storing unit is displayed to an action end state in which only a second part content selected from the part-content storing unit is displayed in a rectangular area on the guidance screen, an action of the first part content is an action for reducing, while fixing one end in a display section of the first part content, which is one end of the display section in a first direction on the guidance screen, in the first direction, the display section in the first direction at first reducing speed to reduce width in the first direction to zero and reducing the display area in a second direction orthogonal to the first direction such that reducing speed of the display section in the second direction increases at a fixed rate from zero to second reducing speed from other end of the display section toward one end of the display section, an action of the second part content is an action for reducing, in time reversal of the action from an action end time to an action start time, while fixing one end in the first direction of a display section of the second part content in the first direction, the display section in the first direction at the first reducing speed to reduce width in the first direction to zero and reducing the display area in the second direction such that reducing speed of the display section in the second direction increases at the fixed rate from zero to the second reducing speed from other end of the display section toward one end of the display section, and the other end in the display section of the first part content and the other end in the display section of the second part content face each other.

21. The video information delivery and display system according to claim 1, wherein the part content stored in the part-content storing unit is delivered from a video information delivery device mounted on the train and connected to the train information devices.

22. The video information delivery and display system according to claim 1, wherein the guidance-screen creating unit, the part-content storing unit, the part-arrangement-definition-data storing unit, and the part-action-definition-data storing unit are provided in the display devices.

23. The video information delivery and display system according to claim 1, wherein the video information delivery device is connected to diverting devices respectively mounted on the cars, the diverting devices are connected to the display devices of the cars on which the diverting devices are mounted, and the guidance-screen creating unit, the part-content storing unit, the part-arrangement-definition-data storing unit, and the part-action-definition-data storing unit are provided in the diverting devices.

24. The video information delivery and display system according to claim 1, wherein, in the part-content storing unit, the part content is stored as vector data.

25. A video information delivery and display method for, in a train including: train information devices respectively mounted on cars, which form a train, and configured to manage train information in association with one another; display devices respectively mounted on the cars and including display units configured to display a guidance screen; a part-content storing unit configured to store a plurality of part contents, each of the part contents is a content at a part level, used for formation of the guidance screen; a part-arrangement-definition-data storing unit configured to store part arrangement definition data for defining arrangement of the part content on the guidance screen relative to other contents on the guidance screen; and a part-action-definition-data storing unit configured to store part action definition data for individually defining an action of the part content itself on the guidance screen, delivering video information and causing the display devices to display the video information, the video information delivery and display method comprising:

acquiring the train information from the train information devices;

selecting, according to a guidance content displayed on the guidance screen, based on a train state which has been determined based on the train information, one of the part contents used for the formation of the guidance screen from the part-content storing unit; and arranging the selected part content on the guidance screen according to the part arrangement definition data, sequentially creating, for each of a plurality of continuous frames in time series obtained by changing little by little the arranged part content on the guidance screen according to the part action definition data, image files serving as sources of creating the frames, displaying the frames based on the image files on the display units in time series, and erasing the image files from a memory after the display.

26. The video information delivery and display system according to claim 1, wherein the screen creating unit arranges, according to the part arrangement definition data and the part action definition data, while reducing and displaying, in the guidance screen, the entire guidance content with respect to the guidance content currently displayed on the guidance screen, a part content different from the part content forming the guidance content in a margin section formed in the guidance screen by the reduction of the entire guidance content and incorporates the part content arranged in the margin section into the margin section to display the part component.

27. The video information delivery and display system according to claim 26, wherein the part content is a still image, and the screen creating unit creates the continuous frames in time series by causing the part content arranged on the guidance screen to act on the guidance screen according to the part action definition data.

28. The video information delivery and display system according to claim 3, wherein the screen creating unit arranges, according to the part arrangement definition data and the part action definition data, while reducing and displaying, in the guidance screen, the entire guidance content with respect to the guidance content currently displayed on the guidance screen, a part content different from the part content forming the guidance content in a margin section formed in the guidance screen by the reduction of the entire guidance content and incorporates the part content arranged in the margin section into the margin section to display the part component and erases the image files after the display.

29. The video information delivery and display system according to claim 26, wherein the screen creating unit creates a part content obtained by processing a content of temporary information input from an outside of the train or on the train into a character drawing, arranges the created part content in the margin section, and moves the part content.

* * * * *